US005506559A

United States Patent [19]

Yamaguchi

[11] Patent Number: 5,506,559

[45] Date of Patent: Apr. 9, 1996

[54] CHOKE COIL FOR ELIMINATING COMMON MODE NOISE AND NORMAL MODE NOISE

[75] Inventor: Kouichi Yamaguchi, Nagaokakyo, Japan

[73] Assignee: Murata Manufacturing Co., Ltd., Nagaokakyo, Japan

[21] Appl. No.: 319,249

[22] Filed: Oct. 6, 1994

[30] Foreign Application Priority Data

Oct. 7, 1993 [JP] Japan ..... 5-251315

[51] Int. Cl.[6] ..... H01F 17/06; H01F 27/30

[52] U.S. Cl. ..... 336/83; 336/212; 336/215; 336/233

[58] Field of Search ..... 336/83, 212, 214, 336/215, 233, 234

[56] References Cited

U.S. PATENT DOCUMENTS 2,015,674 10/1935 Hayes ..... 336/83

FOREIGN PATENT DOCUMENTS 33021 10/1956 Germany ..... 336/83

300586 9/1965 Netherlands ..... 336/83

*Primary Examiner*—Thomas J. Kozma

*Attorney, Agent, or Firm*—Burns, Doane, Swecker & Mathis

[57] ABSTRACT

A common mode choke coil has a couple of coils, a magnetic frame in which the coils are encased, the magnetic frame forming closed magnetic circuits around the respective coils, and a magnetic core which pierces through the magnetic frame. The frame is made of an insulating magnetic material which has a relative magnetic permeability of more than one, preferably two through some scores. For example, a mixture of ferrite powder of Ni—Zn and resin is used as the material of the frame. The core is made of a material which has a relative magnetic permeability of preferably several thousands, such as ferrite and amorphous.

14 Claims, 3 Drawing Sheets

CHOKE COIL FOR ELIMINATING COMMON MODE NOISE AND NORMAL MODE NOISE

BACKGROUND OF THE INVENTION

1. Field of the Invention

The present invention relates to a common mode choke coil, and more particularly to a common mode choke coil for eliminating noise flowing out of an electronic appliance.

2. Description of Related Art

A common mode choke coil generally has a component of normal mode leakage inductance even a little, and thereby, the common mode choke coil is effective to eliminate normal mode noise. However, if normal mode noise is strong, not only the common mode choke coil but also a normal mode choke coil is necessary to eliminate noise.

On the other hand, if the common mode choke coil has a relatively large component of normal mode leakage inductance, the leakage magnetic flux therefrom badly influences the adjacent circuits. In this case, it is necessary to provide a magnetic shield around the common mode choke coil.

SUMMARY OF THE INVENTION

An object of the present invention is to provide a common mode choke coil which is sufficiently effective to eliminate normal mode noise as well as common mode noise and does not have so strong a leakage magnetic flux as to badly influence the adjacent circuits.

In order to attain the object above, a common mode choke coil according to the present invention comprises a couple of coils, a magnetic frame in which the coils are encased, the magnetic frame forming closed magnetic circuits around the respective coils, and a magnetic core which pierces through the frame.

While common mode noise currents flow in the coils, magnetic fluxes occur around the coils. The magnetic fluxes are combined and circulate in the magnetic core. During the circulation, the magnetic fluxes are converted into heat energy by an eddy-loss and decline. Thus, the common mode noise currents are weakened. While a normal mode noise current flows in the coils, magnetic fluxes occur around the coils. The magnetic fluxes circulate in the frame without leaking. During the circulation, the magnetic fluxes are converted into heat energy by eddy-losses and decline. Thus, the normal mode noise current is weakened.

BRIEF DESCRIPTION OF THE DRAWINGS

This and other objects and features of the present invention will be apparent from the following description with reference to the accompanying drawings, in which.

DETAILED DESCRIPTION OF THE PREFERRED EMBODIMENTS

An exemplary common mode choke coil according to the present invention is described with reference to the accompanying drawings.

Figure 1:
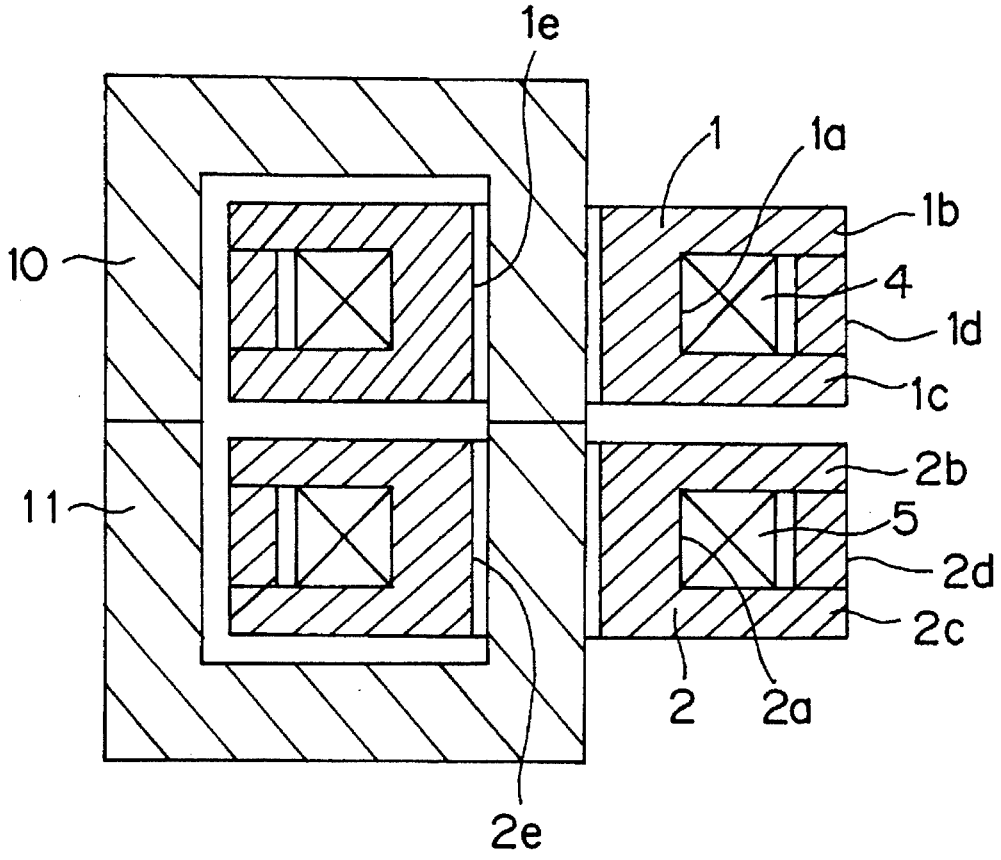
FIG. 1 is a sectional view of an exemplary common mode choke coil according to the present invention.

As shown in FIG. 1, the common mode choke coil comprises two frames 1 and 2, a couple of coils 4 and 5 which are wound around the frames 1 and 2 respectively, and two U-shaped cores 10 and 11. The frame 1 has a cylindrical body 1*a*, flanges 1*b* and 1*c* disposed at both ends of the cylindrical body 1*a*, and a lid 1*d* fitted between the flanges 1*b* and 1*c* at the periphery. Likewise, the frame 2 has a cylindrical body 2*a*, flanges 2*b* and 2*c*, and a lid 2*d*. The frames 1 and 2 are made of an insulating magnetic material which has a relative magnetic permeability of more than one, preferably, two to some scores. For example, a mixture of ferrite powder of Ni—Zn and resin is used as the material of the frames 1 and 2.

The coils 4 and 5 are wound around the cylindrical bodies 1*a* and 2*a* of the frames 1 and 2 respectively. The winding start portions and the winding end portions of the coils 4 and 5 are fixed on terminals (not shown) disposed on the frames 1 and 2 respectively.

One of the legs of the core 10 is inserted in a hole 1*e* made in the cylindrical body 1*a* of the frame 1, and one of the legs of the core 11 is inserted in a hole 2*e* made in the cylindrical body 2*a* of the frame 2. Then, the legs of the cores 10 and 11 are butted, and the cores 10 and 11 form a ring core. The cores 10 and 11 are made of a material which has a relative magnetic permeability of several thousands, such as ferrite and amorphous of Fe, Ni, Co or Mn.

Figure 2:
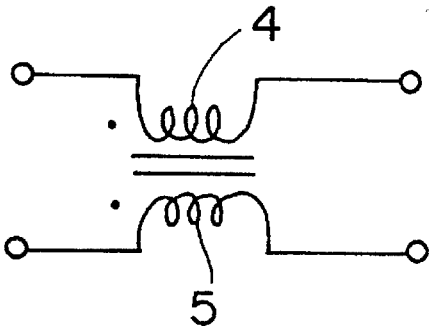
FIG. 2 is an electrical equivalent circuit diagram of the common mode choke coil of FIG. 1.

FIG. 2 shows the electrical equivalent circuit of the common mode choke coil.

Figure 3:
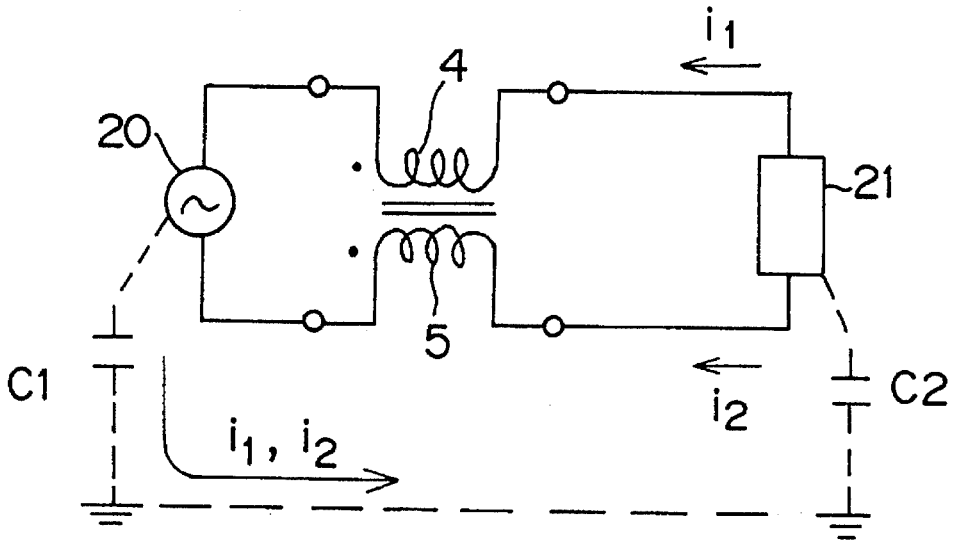
FIG. 3 is an electrical circuit diagram explaining the action of the common mode choke coil of FIG. 1 to eliminate common mode noise.
Figure 4:
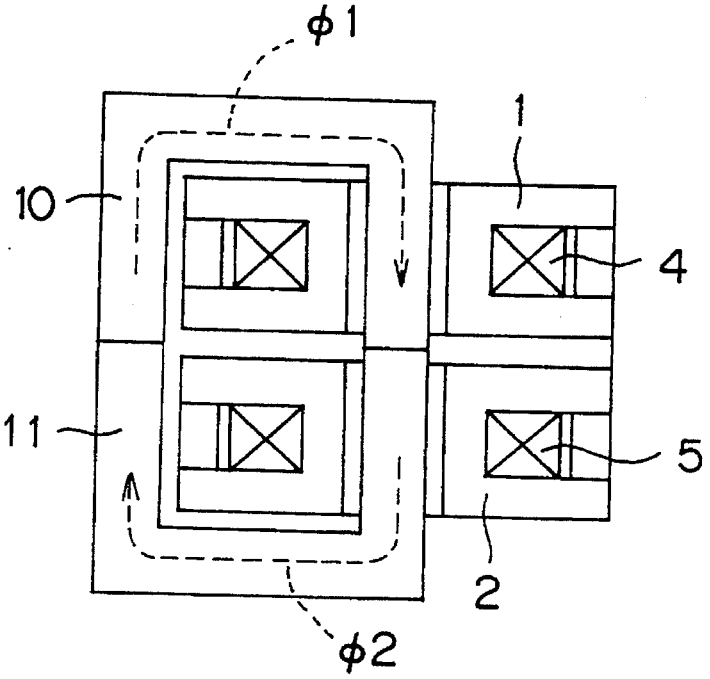
FIG. 4 is a magnetic circuit diagram explaining the action of the common mode choke coil of FIG. 1 to eliminate common mode noise.

Now, referring to FIGS. 3 and 4, the action of the common mode choke coil to eliminate common mode noise is described.

As can be seen in FIG. 3, the common mode choke coil is connected with two signal lines which are provided between a power source 20 and a load 21 such as an electronic appliance. A stray capacity C1 occurs between the power source 20 and the ground, and a stray capacity C2 occurs between the load 21 and the ground. While common mode noise currents $i_1$ and $i_2$ flow in the signal lines as indicated with the arrows in FIG. 3, magnetic fluxes $\phi 1$ and $\phi 2$ occur in the coils 4 and 5 as shown in FIG. 4. The magnetic fluxes $\phi 1$ and $\phi 2$ are combined and circulate in a closed magnetic circuit of the cores 10 and 11. During the circulation, the magnetic fluxes $\phi 1$ and $\phi 2$ decline gradually without leaking. This is because the magnetic fluxes $\phi 1$ and $\phi 2$ are converted into heat energy by an eddy-current loss or the like. In this way, the common mode noise currents $i_1$ and $i_2$ are weakened.

Figure 5:
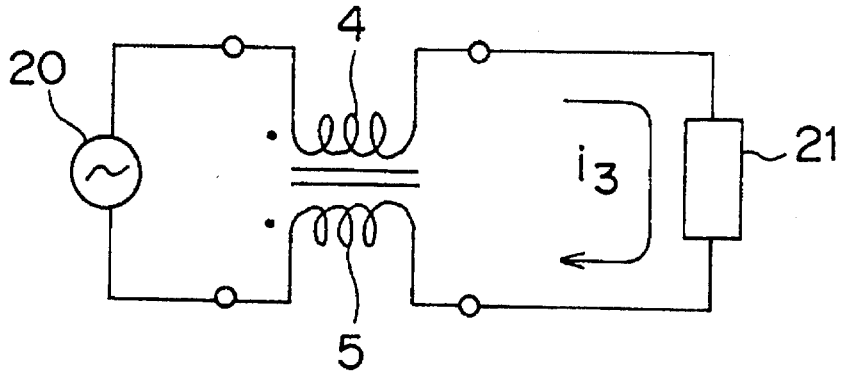
FIG. 5 is an electrical circuit diagram explaining the action of the common mode choke coil of FIG. 1 to eliminate normal mode noise.
Figure 6:
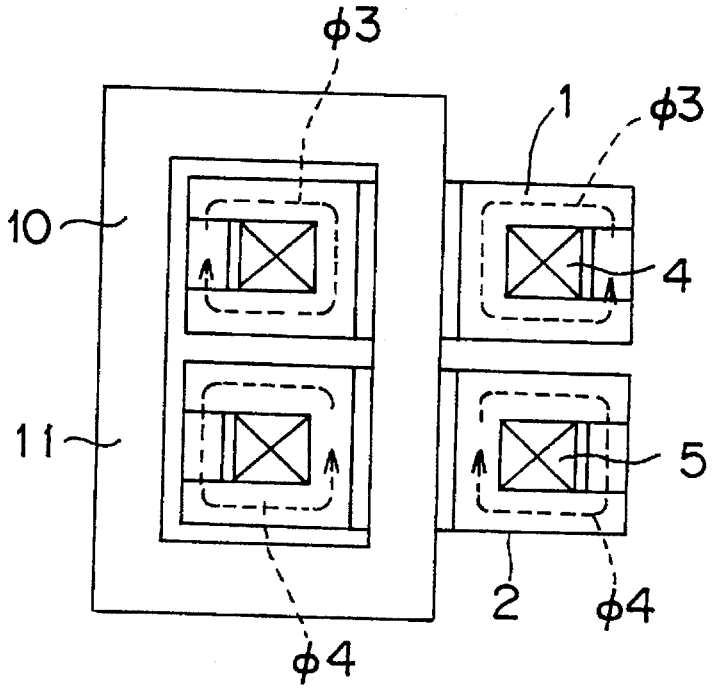
FIG. 6 is a magnetic circuit diagram explaining the action of the common mode choke coil of FIG. 1 to eliminate normal mode noise.

Next, referring to FIGS. 5 and 6, the action of the common mode choke coil to eliminate normal mode noise is described.

While a normal mode noise current $i_3$ a flows in the two signal lines as indicated with the arrow in FIG. 5, magnetic fluxes $\phi 3$ and $\phi 4$ occur in the coils 4 and 5 as shown in FIG.

6. The magnetic fluxes $\phi 3$ and $\phi 4$ circulate in closed magnetic circuits of the frames 1 and 2 respectively without leaking. During the circulation, the magnetic fluxes $\phi 3$ and $\phi 4$ are converted into heat energy by eddy-current losses or the like and gradually decline. In this way, the normal mode noise current $i_3$ is weakened.

As is apparent form the above description, since the common mode choke coil has magnetic frames 1 and 2 which contain coils 4 and 5 respectively and magnetic cores 10 and 11 which pierce through the frames 1 and 2, the magnetic fluxes $\phi 1$ through $\phi 4$ caused by flows of the common mode noise currents $i_1$ and $i_2$ and the normal mode noise current $i_3$ are converted into heat energy by eddy-current losses or the like inside the frames 1 and 2 and the cores 10 and 11, and thereby decline. Thus, common mode noise and normal mode noise are eliminated. In the structure, the magnetic fluxes $\phi 1$ through $\phi 4$ do not leak from the common mode choke coil, and it is no longer necessary to provide a magnetic shield around the choke coil.

In the above embodiment, coils are encased in separate frames, but it is possible to encase a plurality of coils in a single frame. The lid of the frame may be provided not only by fitting of a molded article but also by insert molding.

In the above embodiment, two U-shaped cores are used. However, it is possible to combine a U-shaped core with an E-shaped core or an I-shaped core. It is also possible to use a solid type core whose shape is a ring with or without a bridge in the middle as well as to combine divided type cores.

Further, a partition wall may be inserted in the middle of each coil wound in a frame.

Although the present invention has been described in connection with the preferred embodiment, it is to be noted that various changes and modifications are possible to those who are skilled in the art. Such changes and modifications are to be understood as being within the scope of the present invention.

What is claimed is:

1. A choke coil for reducing common mode noise and normal mode noise, comprising:

at least two coils;

a magnetic frame in which the coils are encased, the magnetic frame forming closed magnetic circuits around the respective coils to attenuate normal mode noise; and a magnetic core which pierces through the frame and the coils, the magnetic core forming a closed magnetic circuit to attenuate common mode noise.

2. A choke coil as claimed in claim 1, wherein the frame is made of a material which has a relative magnetic permeability within a range of one or more.

3. A choke coil as claimed in claim 1, wherein the frame is made of a mixture of ferrite of Ni—Zn and resin.

4. A choke coil as claimed in claim 1, wherein the core is made of a material which has a relative magnetic permeability of several thousands.

5. A choke coil as claimed in claim 1, wherein the core is made of ferrite material.

6. A choke coil as claimed in claim 1, wherein the core is made of amorphous material.

7. A choke coil as claimed in claim 1, wherein:

the frame comprises a cylindrical body, flanges disposed at both ends of the cylindrical body, and a lid fitted between the flanges at a periphery; and the core pierces through the cylindrical body of the frame.

8. A choke coil for reducing common mode noise and normal mode noise, comprising:

a first coil;

a first magnetic frame in which the first coil is encased, the first magnetic frame forming a closed magnetic circuit around the first coil to attenuate normal mode noise;

a second coil;

a second magnetic frame in which the second coil is encased, the second magnetic frame forming a closed magnetic circuit around the second coil to attenuate normal mode noise; and a magnetic core which pierces through the first frame, the second frame and the coils, the magnetic core forming a closed magnetic circuit to attenuate common mode noise.

9. A choke coil as claimed in claim 8, wherein the first and second frames are made of a material which has a relative magnetic permeability within a range of one or more.

10. A choke coil as claimed in claim 8, wherein the first and second frames are made of a mixture of ferrite of Ni—Zn and resin.

11. A choke coil as claimed in claim 8, wherein the core is made of a material which has a relative magnetic permeability of several thousands.

12. A choke coil as claimed in claim 8, wherein the core is made of ferrite material.

13. A choke coil as claimed in claim 8, wherein the core is made of amorphous material.

14. A choke coil as claimed in claim 8, wherein:

each of the first and second frames comprises a cylindrical body, flanges disposed at both ends of the cylindrical body, and a lid fitted between the flanges at a periphery; and the core pierces through the cylindrical bodies of the first and second frames.

* * * * *